US010899031B2

(12) United States Patent
Kaye

(10) Patent No.: US 10,899,031 B2
(45) Date of Patent: Jan. 26, 2021

(54) SYSTEM FOR MATERIAL APPLICATION AND CUTTING

(71) Applicant: Perry Teri Toys, LLC, Davie, FL (US)

(72) Inventor: Perry Kaye, Cooper City, FL (US)

(73) Assignee: Perry Teri Toys, LLC, Davie, FL (US)

( * ) Notice: Subject to any disclaimer, the term of this patent is extended or adjusted under 35 U.S.C. 154(b) by 0 days.

(21) Appl. No.: 15/751,835

(22) PCT Filed: Aug. 10, 2016

(86) PCT No.: PCT/US2016/046427

§ 371 (c)(1),
(2) Date: Feb. 9, 2018

(87) PCT Pub. No.: WO2017/027637

PCT Pub. Date: Feb. 16, 2017

(65) Prior Publication Data

US 2018/0229387 A1 Aug. 16, 2018

Related U.S. Application Data

(60) Provisional application No. 62/221,223, filed on Sep. 21, 2015, provisional application No. 62/202,964, filed on Aug. 10, 2015.

(51) Int. Cl.
*B26B 29/06* (2006.01)

(52) U.S. Cl.
CPC ..... *B26B 29/06* (2013.01)

(58) Field of Classification Search
CPC ..... B26B 29/06
See application file for complete search history.

(56) References Cited

U.S. PATENT DOCUMENTS 3,257,991 A * 6/1966 Mosch ..... B43K 29/18 401/29
3,706,106 A * 12/1972 Leopoldi ..... A61B 17/3213 7/158
4,635,309 A * 1/1987 Larsen ..... B25F 1/04 30/162
4,868,989 A * 9/1989 Renaud ..... B26B 5/005 30/293
4,903,409 A * 2/1990 Kaplan ..... B26B 5/005 30/293
5,170,562 A * 12/1992 Carmichael ..... B26B 29/06 30/289

(Continued)

*Primary Examiner* — Omar Flores Sanchez
(74) *Attorney, Agent, or Firm* — Diana Mederos; Mederos Legal PLLC

(57) ABSTRACT

A system comprising a material decorating and cutting device used with an alignment apparatus to simultaneously cut and deposit decorating material on arts and crafts materials surfaces such as sheet stock. The cutting device contains a reservoir with decorating material such as paint, glue, ink, pigment, or three-dimensional material such as wax. The cutting device has a tip with a nib and a blade. The nib facilitated the transfer of decorating material to a target material such as paper or wood while the blade cutting edge cuts the target material. The alignment apparatus provides for continuous decorating and cutting on a surface. The system provides an efficient, fun, and safe way to participate in arts and crafts activities.

49 Claims, 7 Drawing Sheets

(56) References Cited

U.S. PATENT DOCUMENTS 5,233,748 A * 8/1993 Logan ..... B26B 5/005 30/293
5,996,237 A * 12/1999 Sanders ..... B26B 29/06 30/293
6,547,098 B1 * 4/2003 Kaye ..... B26B 5/001 222/191
6,554,163 B1 * 4/2003 Kaye ..... B26B 5/001 222/191
D480,978 S * 10/2003 Cardew ..... D10/65
6,701,636 B2 * 3/2004 Scarborough ..... G01B 3/1041 33/768
6,813,839 B2 * 11/2004 McLean ..... B26B 5/00 144/144.1
6,951,058 B2 * 10/2005 McLean ..... B26B 5/00 144/372
7,040,035 B1 * 5/2006 Scarborough ..... G01B 3/1084 33/668
7,054,708 B1 * 5/2006 Aamodt ..... B26D 5/005 700/122
7,125,186 B1 * 10/2006 Stokes ..... B43K 7/005 401/8
7,254,855 B2 * 8/2007 McCreesh ..... B25H 7/04 33/27.03
7,607,849 B2 * 10/2009 Barker ..... B43K 24/06 401/195
7,845,259 B2 * 12/2010 Workman ..... B26D 7/2614 83/436.3
7,895,760 B1 * 3/2011 Bareis ..... B43L 7/00 33/483
7,930,958 B2 * 4/2011 Workman ..... B26D 7/2628 30/161
8,191,192 B1 * 6/2012 Barker ..... B26B 5/002 7/158
8,201,484 B2 * 6/2012 Workman ..... B26D 7/2628 83/527
8,434,235 B2 * 5/2013 Carter ..... B26B 29/06 30/293
8,646,366 B2 * 2/2014 Workman ..... B26D 5/005 83/373
9,067,339 B2 * 6/2015 Mallet ..... B28D 1/228
9,919,436 B2 * 3/2018 Johnson ..... B26B 11/008
10,093,028 B2 * 10/2018 Johnson ..... B26B 11/008
10,343,296 B2 * 7/2019 Hall ..... B26D 7/1863
10,434,668 B1 * 10/2019 Kollias ..... B26B 5/00
2002/0124423 A1 * 9/2002 Carlson ..... B26B 29/06 33/27.12
2004/0148794 A1 * 8/2004 McLean ..... B26B 5/00 33/562
2004/0168557 A1 * 9/2004 Carlson ..... B26B 29/06 83/454
2005/0044733 A1 * 3/2005 McLean ..... B26B 5/00 33/27.12
2008/0022536 A1 * 1/2008 Hsu ..... B26B 29/06 30/310
2008/0086898 A1 * 4/2008 Hasegawa ..... B26B 3/00 30/314
2008/0222899 A1 * 9/2008 Durham ..... B26B 5/005 30/291
2012/0043447 A1 * 2/2012 Franczyk ..... A21C 11/106 248/393

* cited by examiner

SYSTEM FOR MATERIAL APPLICATION AND CUTTING

PRIORITY CLAIM

This application is a United States national stage application of PCT application PCT/US2016/046427 having an international filing date of Aug. 10, 2016, and which claims priority to U.S. provisional application No. 62/202,964 filed on Aug. 10, 2015, and to U.S. provisional application No. 62/221,223 filed on Sep. 21, 2015.

TECHNICAL FIELD

The present disclosure relates to methods and apparatuses for material application and cutting systems. More specifically, the material application and cutting system comprises a decorating and cutting device, an alignment apparatus, and may include a planned-thickness target material project pad in a kit. The present disclosure pertains to devices, systems, and methods that individuals of all ages may efficiently, safely, and precisely utilize in material application and cutting arts and crafts projects.

BACKGROUND

Traditionally, material application and cutting projects involved multiple tools and much mess, especially in venues like classrooms, daycares, children's museums, and at home. Typical material application and cutting tool projects require various types of paper, sheet stock, scissors, crayons, markers, glue, highlighters, inks and paint, plus other assorted material. If a child desired to create a paper flower out of different colors of paper, the child would typically first draw the flower or the parts of the flower on one to several sheets of paper. Then the child may add additional detail with markers, crayons, or colored pencils. Then the child would need to precisely cut out the necessary parts and glue them together. For example, if the child wants the center of the flower to be orange, the petals yellow, and the stem and leaves green, then the child would need to color each either before or after cutting and then glue the pieces together. If the child does not cut out a flower petal exactly to conform to the drawing or outline of the flower petal, then the petal will not have the desired aesthetic. Coordination of drawing and the cutting out of those drawings is a difficult task and requires fine motor skills that many people do not have. Additionally, with scissors, it is difficult to cut curved, organic, and non-linear shapes from paper. Craft or artist knives are sometimes used for this but are too dangerous for many people to use. Swiveling blades are sometimes used for this but are not only dangerous but also difficult to control.

To correctly, and safely, use a swiveling blade, craft or artist knife, one must orient it such that it is perfectly aligned with an intended cut while simultaneously keeping the blade, as one traverses the target material, with the correct cutting orientation and pressure to enable a user to easily realize his/her envisioned design. This is currently difficult and cumbersome. Additionally, determining how much pressure to apply to the blade of a traditional craft or artist knife while it is being used is difficult. Applying too little pressure may not cut the sheet stock, and applying too much pressure causes the user to waste effort cutting the cutting surface or the table supporting the sheet stock and potentially damaging the underlying surface and tool.

Because a blade has only a limited number of orientations that will work well and because people have such variances in how they hold things (i.e. people are left or right handed, have variances in their hand size, shape and the way in which they normally hold a pencil or other creative instrument), it is quite difficult to train a person to consistently operate a cutting device with the blade oriented in an optimal position during use. Adding to the complexity is the nature under which the blade will operate. As the user pushes it to and fro, they also shift their hand, wrist, elbow, arm, and body and each of these changes can affect the blade's orientation. Pushing and pulling, as anyone would imagine, also changes how the pressure affects the blade via the handle. Correct alignment during use of the cutting instrument is quite difficult.

Therefore, there is a present need for an alignment apparatus that is comfortable and ergonomic while working to orient the cutting edge and set an optimal pressure for during use.

In response to some of these problems, a device that simultaneously decorates and cuts was described and claimed in U.S. Pat. Nos. 6,547,098, 6,554,163, and 6,557,730. Embodiments of the devices described relate generally to a marker-like device having a cutting edge secured within the nib of the marker. When a user presses the marker to paper and moves the marker along the surface of the paper, the marker simultaneously deposits color and creates a cut edge. The marker could be rotated so that a user can use one side of the nib containing the small cutting edge to cut and color simultaneously, or the user could use the other side of the nib to color only.

However, this device does not address all problems. First, the device requires a user to manually orient the cutting edge in the direction of the cut. This makes it difficult to use and requires the user to not only maintain correct orientation of the marker but also the cutting edge and its alignment with the paper.

Second, the device lacked a way of using it while being able to also see, with an unobstructed view, the line where the cut would take place because the cutting edge could not be outwardly visible without risking the blade coming loose or being able to be pulled out of the nib by a user. The sharp blade was also concealed within the felt marker nib and not visible which made some consumers skeptical because they could not see where the blade tip was precisely being placed. There is a need to see where the cutting edge will be cutting, to have the ability to control and guide it, while also configured so that the blade will not be easily removed from the device.

Third, if the marker was not positioned or angled correctly, the device would not effectively cut. This was especially problematic when a user wanted to draw and simultaneously cut curvy shapes or lines that would require a rotation of the device using the fingers, the wrist and the paper about the device. Therefore, the markers were not particularly easy for everyone to use because the cutting device would not account for variation in the many ways people naturally hold a marker, pen, or pencil. The traditional way of holding the cutting device is not the same as the traditional way of holding a marker, so users would naturally grasp the cutting device incorrectly, and the cutting device would not work. A user could not focus on the creative aspect of material application and cutting but had to focus on the technical aspect of attempting to hold the device correctly, so the device could simultaneously cut and color. If a user pressed too hard, the nib and the blade could bend or become damaged. There is a present need for a simultaneous cutting and decorating device that is more effective and easier to use.

Fourth, consumers needed to use an additional protective layer or surface to place over the tabletop or other surface in which cutting was to be performed. If not, the cutting edge might damage the tabletop surface because too much pressure would be applied when using the cutting device. Traditional cutting surfaces only support one target material at a time, so more space is needed, and it is difficult to use in a small area. This was problematic when a user desired to cut and color on thick-backed labels due to the variation in thickness of the label material layers. Presently, there is a need for eliminating a mandatory surface protective layer to protect the underlying surface from using a cutting device with too much pressure.

Furthermore, there is a lack of corresponding material application and cutting apparatuses and systems to complement a device that simultaneously cuts and decorates. Consumers need target material products that complement the function of simultaneously cutting and coloring, in order to make the most use out of the device. There is presently a need for a system to maximize safety, creativity, and fun for which a system comprising a simultaneous cutting and decorating device can provide.

SUMMARY

What is needed is a safer and fun system comprising a cutting and decorating device with the capability to simultaneously decorate target material, especially when used with an alignment device that is in either a handle form or in a barrel form.

The device comprises a housing and a reservoir and a tip that is partially inserted into a proximal aperture of the device and partially protrudes out from the aperture for contact with target material. The tip accommodates and secures a nib and a blade with a cutting edge support. The blade cutting edge is visible to the naked eye but will not easily cut skin and cannot be easily removed from the device. The tip may be connected to or inserted into the aperture of either a fixed or removable proximal cap. The tip may also contain a depth-stop wear indicator such as a pin secured into the nib or a color change indicator to inform users of wear and ineffective cutting and decorating due to dull surfaces.

The handle form of an alignment apparatus comprises a rotatable cuff that has at least one bearing inside to facilitate rotation of a device that is inserted into the rotatable cuff. The bearing has an inner ring and an outer ring with ball bearings in between for fluid rotation motion. The torque of dragging the device about a target material surface facilitates the spin of the device within the rotatable cuff while the handle does not move. The alignment apparatus preferably positions the device tip perpendicularly from the surface of the target material at a 90-degree angle. The proximal end of the holder that contains the bearing and the rotatable cuff is connected to a cuff ring which is connected to a joint which is connected to a handle which may also comprise at least one leg flush with the tip about the surface of target material.

The barrel form of an alignment apparatus comprises a barrel body that houses at least one bearing, at least one spring in at least one spring chamber, a distal aperture, a proximal aperture, at least one bearing stop, and may optionally include contoured grip. The spring may be a non-rotating compressible spring with an open distal end or may be a rotatable compressible spring with both a proximal and distal bearing and ledge upon which the bearing rests and to which spring is connected. The barrel form of an alignment apparatus may also have an orientation element such as a glide surface or placement guide for effective placement of the tip to the target material. The barrel form of an alignment apparatus utilizes at least one spring to either even out or reduce the pressure a user applies to the target material from holding the alignment apparatus, ensuring even and effective cutting and deposition of decorating material while holding the barrel at an angle from 10 to 170 degrees.

The barrel form of an alignment apparatus may contain both a proximal and distal spring chamber and spring to facilitate pressure compensation from the proximal spring and the ability to retract or eject a device from the alignment apparatus by pressing a distal end cap to compress or release the distal end spring inside the distal spring chamber.

The system may be contained in a kit with at least one planned-thickness target material project pad and may be used by selecting at least one device, inserting the device into the alignment apparatus, applying the proximal end of the device to the target material while gripping the alignment device and dragging the device tip along the surface of target material to cut and decorate complex designs without the need to lift the device from the target material.

BRIEF DESCRIPTION OF THE DRAWINGS

The accompanying drawings that are incorporated in, and constitute a part of, this specification illustrate several embodiments of the disclosure and together with the description serve to explain the principles of the disclosure.

DESCRIPTION

Introduction

Figure 1:
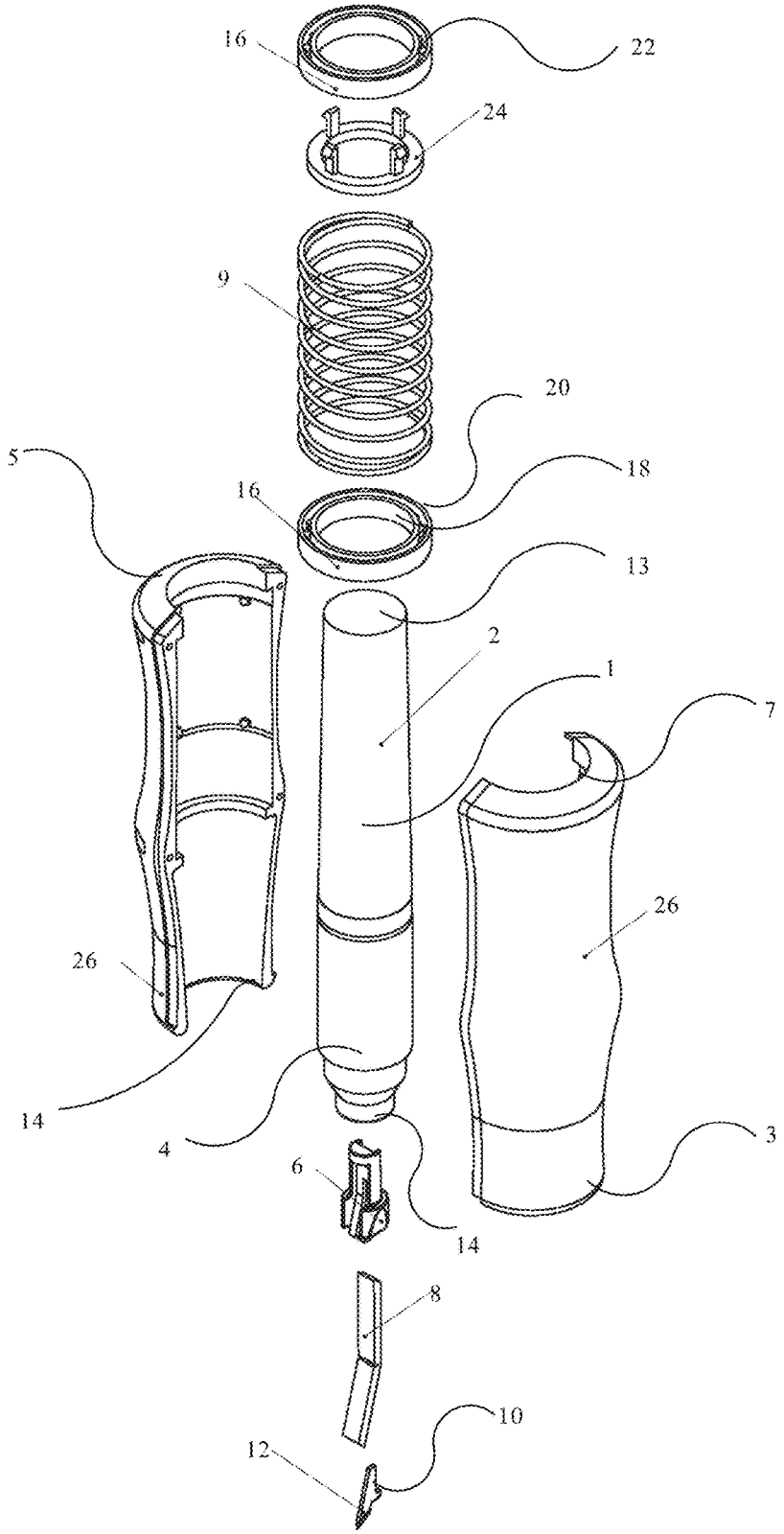
FIG. 1 illustrates an exploded view of a cutting and decorating device and a barrel alignment apparatus.
Figure 2A:
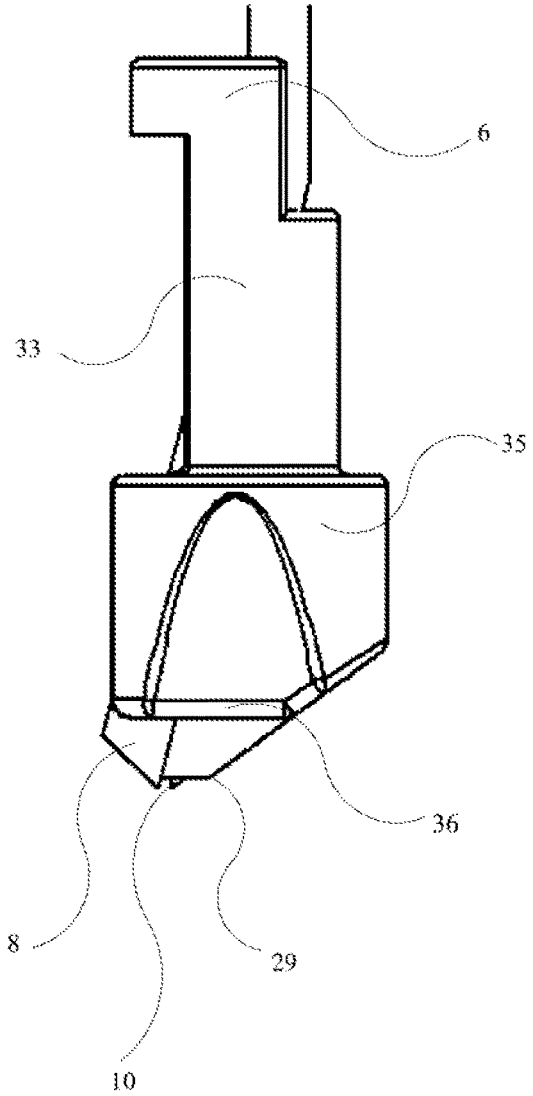
FIG. 2*a* illustrates a side view of device tip components.
Figure 2B:
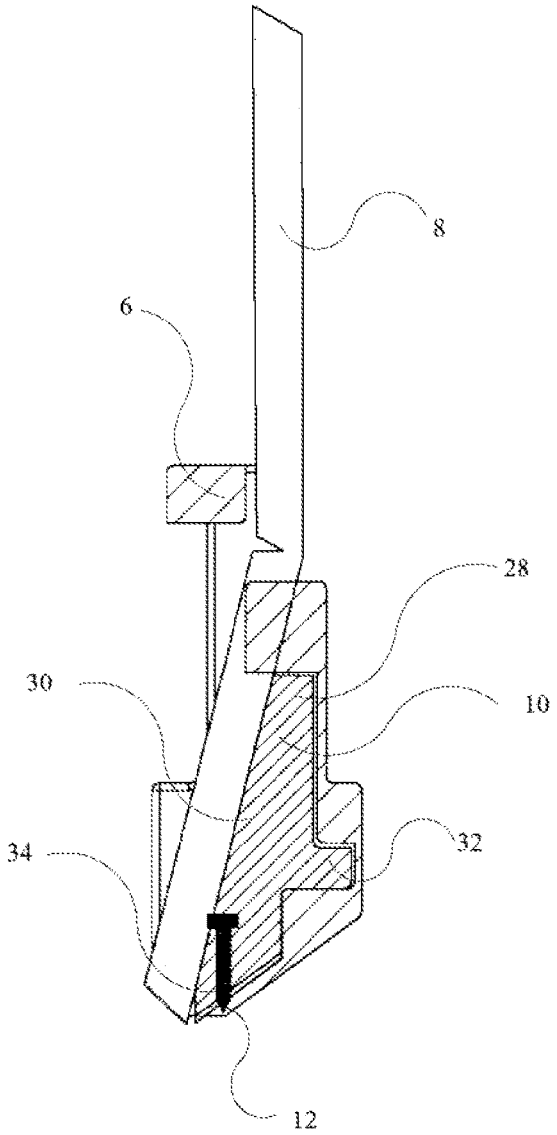
FIG. 2*b* illustrates a vertical cross-section view of a tip, nib, blade, and depth-stop wear indicator.

The present disclosure provides generally for a system comprising a cutting and decorating device and an alignment apparatus. In addition, a planned-thickness target material cutting pad may also be included together with the system to form a kit. The system and kit are a safe, fun, and precise material application and cutting system.

More specifically, a cutting and decorating device allows a user to simultaneously apply decorating material and cut a target material safely, efficiently, and accurately. The cutting and decorating device may be used in conjunction with an alignment apparatus. The alignment apparatus may allow for easier and more precise cutting of a target material. Furthermore, the improved cutting device and the device holder may be used with a material application and cutting pad having multiple layers of target material. The apparatuses described herein provide for a fun, safe, and effective system to create, with sheet stock, many different projects including, but not limited to, scrapbook pages, do-it-yourself crafts, greeting and gift cards, school projects, signs, collages and other works while providing for an engaging material application, decoration and cutting arts and crafts experience.

In the following sections, detailed descriptions of examples and methods of the disclosure will be given. The description of both preferred and alternative examples are exemplary only, and it is understood to those skilled in the art that variations, modifications, and alterations may be apparent. Therefore, the examples do not limit the breadth of the aspects of the underlying disclosure as defined by the claims.

Glossary

"alignment apparatus" as used herein means a mechanism designed to align a cutting edge during use by a person or mechanism and may be of the handle holder embodiment or of the barrel embodiment.

"bearing" as used herein means an annular apparatus through which a device or a reservoir is threaded and which reduces rotational friction of a device or of a reservoir.

"decorating material" as used herein means any type of material that can be applied to a target material or surface. Decorating material includes, but is not limited to, inks, pigments, dyes, glues, colored glues, clear coats, solid and liquid gels, lacquers, polishes, paints, oil pastels, graphite, etching solutions, oils, stains, waxes, glitter and glitter-containing substances, emulsions, glow-in-the dark substances, fluorescent substances, crayons, black-light sensitive substances, three-dimensional paints, water, foams, chalks, fragranced substances.

"device" as used herein means an apparatus that either allows a user to cut and decorate a target material or cut only a target material. Also referred to as a cutting and decorating device or cutting device.

"material application" as used herein means the process of applying at least one decorating material to at least one target material.

"nib" as used herein means an applicator reaching into a reservoir and capable of applying a decorating material from a tip at the proximal end of a device.

"pad" as used herein means a planned-thickness target material project pad.

"tip" as used herein means an element holding a blade and a nib, particularly of the proximal end of a device.

"reservoir" as used herein means a component, bladder, fiber or foam retainer, or cavity for holding decorating material inside a device.

"target material" as used herein means any surface such as, but not limited to, paper, cloth, natural and synthetic fabrics, natural and synthetic leathers and hides, cardboards, cardstocks, plastics, vellums, foils, felts, woven fibers and wood, adhesive or sticker sheet material, multi-sided sheet material and natural and synthetic sheet material.

"orientation element" as used herein means a surface of the proximal end of an alignment apparatus, and the surface is designed to contact the target material so as to orient the cutting edge to make it easier to operate a device. An orientation element can be a glide surface.

"axis of rotation" as used herein means the center about which the device rotates as it is being used.

"trailing section" as used herein means the section of the tip, of the cutting and decorating device, which is dragged behind the axis of rotation during use and thus is oriented behind a theoretical line, extending perpendicularly to the direction of use, on the side of the axis of rotation that trails the leading section during operation.

"leading section" as used herein means the section of the tip, of the cutting and decorating device, closest to the direction the device is moving to, while it is being used, and in front of the trailing section. It is on the front half of the tip before the axis of rotation as it travels over the target material before the trailing section and is the opposite of the trailing section.

"spring" as used herein means the spring that either evens out or reduces pressure to the device as the user applies pressure to the alignment apparatus and onto the target material. The spring allows for substantially even pressure applied by a user to provide for uniform and smooth cutting and decorating.

"glide surface" as used herein means an orientation element that is a device proximal surface that interacts with the target material during use of the apparatus to support the elements that perform the alignment, cutter depth limiting, cutting and decorating operations.

"user" as used herein means any person, or mechanism, using or directing use of any of the apparatuses or performing any of the methods described.

DETAILED DESCRIPTIONS OF THE DRAWINGS

The following describe the systems and apparatuses and the methods for using them. Generally, a cutting and decorating device and a corresponding alignment apparatus may be used together for improved cutting and decorating. A single alignment apparatus may be used with many different devices and may optimize the pressure, friction, rotation, and hand placement.

Referring now to a cutting and decorating device illustrated in FIG. 1, FIGS. 2*a* and 2*b*, and FIG. 4*b*. The device 1 includes a housing 2, a tip 6, at least one nib 8, at least one blade 10, at least one reservoir 57, a proximal end 3, and a distal end 5. The device components may be made out of natural or synthetic materials. The housing may be cylindrical or may be different as long as the device can be accommodated by an alignment apparatus (also shown in the Figures).

The tip 6 may be shaped so that if an exemplary fibrous nib 8 is used, the fibrous nib 8 may be secured in place by being threaded through and around the tip 6. In an alternative embodiment, a nib 8 may comprise a ballpoint connected to an elongated reservoir. The nib 8 draws decorating material 58 from a reservoir 57 and allows for transfer onto a target material 86. The tip 6 may be a width or diameter such that it fits firmly and securely into the proximal end aperture 14 of the device housing 2 and when used creates a line of a width or thickness with non-limiting examples of that of a micro-point pen to that of a jumbo permanent marker.

The proximal end of the device housing 3 may be tapered or have a smaller circumference than the remainder of the housing 3 which may create greater hold friction, so an alignment apparatus may firmly hold the device 1 in place while simultaneously providing for rotation about a longitudinal axis.

The tip 6 may be firmly in place and flush with the edges of the housing proximal aperture 14 to prevent a user from removing the tip 6 and the nib 8 to gain access to the blade 10. The blade 10 is secured, snapped, or fitted within the tip 6 to prevent unintentional operation. The tip 6 may be over molded into the blade 10 to ensure an aligned or angled orientation and to set its cutting edge 12 protrusion to a specific intended depth. The blade 10 may have an asymmetrical shape with an angled side 30, a cutting edge 12, a blunt end 28, and a protruding side 32 to fit adjacently to the shape of the tip 6 and along a cutting edge support 36. The cutting edge 12 may protrude from the tip 6 by about 0.01 mm to 10 mm. The tip 6 may be made in two sections with cavities for the nib 8 and cutting edge 12 enabling it to be more easily assembled by folding, molding or snapping it into place. The nib 8 may be notched, angled, flat, bent, cut, folded, snapped, fitted, screwed, slid, or woven into the tip 6 that may have crevices, depressions, slits, and receiving areas for a nib 8 and a blade 10. The cutting edge 12 of the blade 10 is secured in the tip 6, and the interior portion 33 of the tip 6 secured inside the housing 2 through the proximal aperture 14, but the protruded cutting edge 12 on the exterior portion 35 of the tip 6 is preferably but not required to be outwardly visible to a user.

The exterior portion 35 of the tip 6 may have a flat glide surface 29, with the cutting edge 12 positioned at a certain angle or orientation or set depth, a nib 8 oriented to cooperate with the glide surface 29 and the cutting edge 12. Safety may be increased due to the cutting edge 12 being positioned and secured so that the cutting edge 12 will not easily cut a user's skin and that the blade 10 is secured inside the tip to prevent easy removal. The glide surface aids in pushing malleable material (including skin) away from the cutting edge 12. In some embodiments, the blade may have a puzzle-piece like shape, and the tip 6 will have a corresponding shape to prevent the pulling of the blade 10 from the tip 6. The tip 6 may have a shape mimicking the shapes of other decorating devices. For example, in some embodiments, a tip 6 may have a tapered shape or may have a rounded shape and may have various thicknesses.

The nib 8 may have different sizes and shapes and may be firm or soft. The nib 8 may be created and positioned such that distortion and wear from pressure and friction are minimized while the nib extends into the reservoir 57 to facilitate the transfer of decorating material 58 to a target material 86. The shape and style of the nib 8 may differ based on the type of decorative material in the reservoir 57. For example, a reservoir 57 containing glue may have a rubber nib to facilitate desired coating of glue while cutting, and a reservoir for containing ink may have a porous plastic or extruded polyester nib to facilitate desired coating of the target material and proper wicking of the ink. In some embodiments, a nib 8 may be in the form of a stamp whereby the decorating material applied by the stamp to target material is supplied from a decorating material reservoir in the device housing. The stamp nib may comprise various shapes and may have cutting edges to correspond to that particular shape. Cut and decorated shape 92 examples include polygons such as squares, asymmetrical shapes such as zig-zags, and other shapes such as stars as illustrated in FIG. 7*c*. Therefore, when a user utilizes a stamp version of the device, the user may apply decorating material and cut in a predetermined shape.

The housing 2 may be solid and firm or may be compressible. For example, a reservoir 57 containing three-dimensional paint may be compressible so the user may squeeze the housing to control the amount of decorative material 58 to be deposited. The device housing 2 may be flexible. When the housing 2 is flexible, the user may contort the shape of the housing 2 to better fit the user's application angle to target material 86. Some embodiments do not contain any decorating material 58 or may contain a removable distal end top 13 that a user may open to deposit his/her own custom decorating material 58. A user may simultaneously or independently cut and deposit decorating material 58 when using the device 1. The device 1 may be reusable or may be disposable.

Figure 7A:
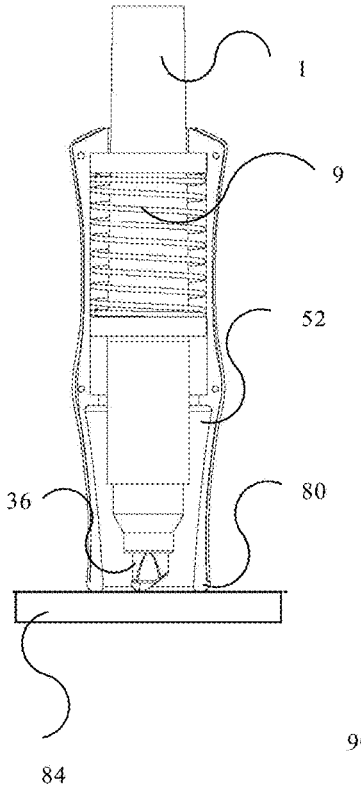
FIG. 7*a* illustrates a vertical cross-section view of a device inside a barrel alignment apparatus applied to a planned-thickness target material project pad.
Figure 7B:
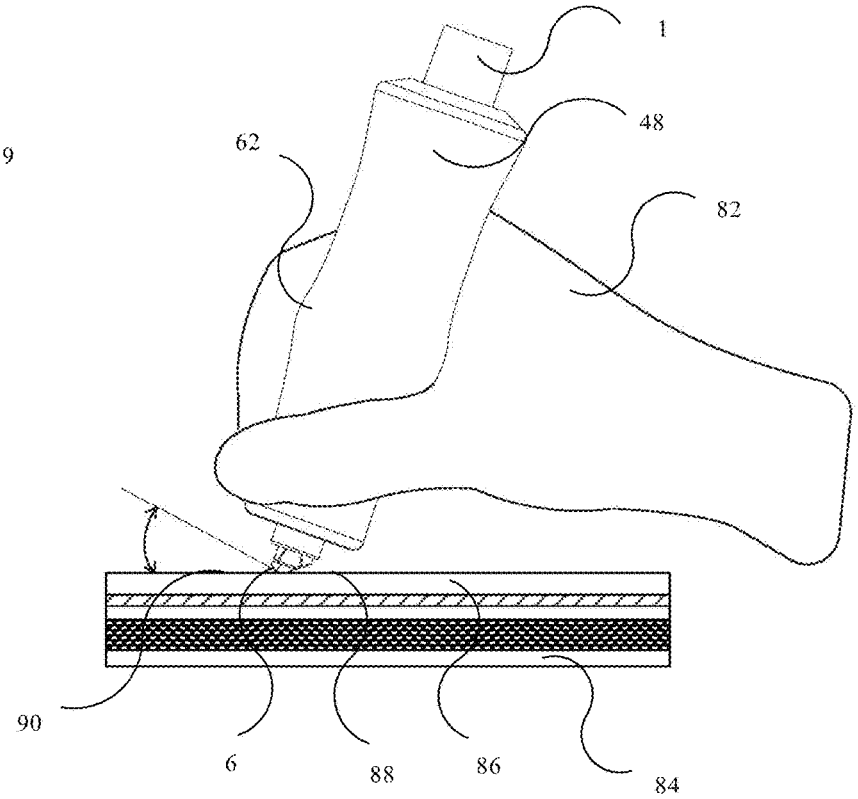
FIG. 7*b* illustrates a side view of a person using a device inside a barrel alignment apparatus at an angle when applied to a planned-thickness target material project pad.
Figure 7C:
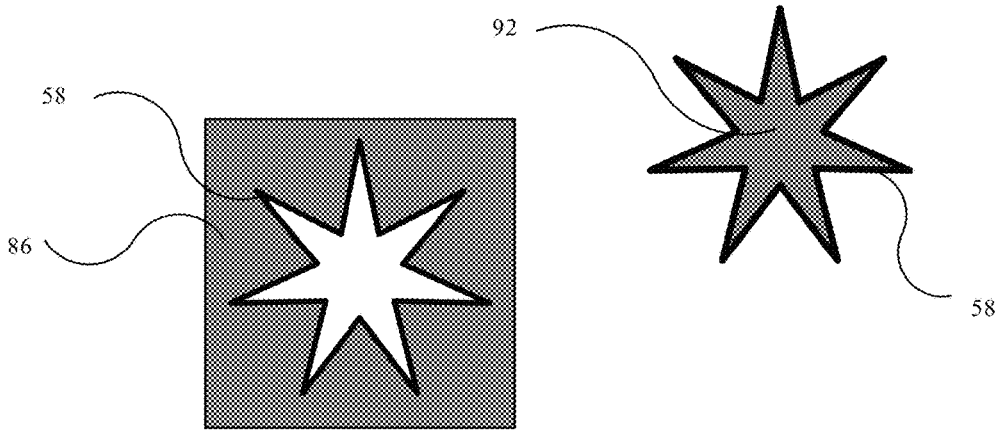
FIG. 7*c* illustrates target material and the resulting shape that has be cut and decorated with a device.

In some embodiments, shown in FIGS. 7*a* and 7*b*, the tip 6 may be divided, across two sides of the diameter of the axis of rotation, into more than one area. With one area being the trailing section 90 and another area being the leading section 88 with regard to placement and direction of movement on a target material 86. The tip 6 may include, on the trailing section 90 past the axis of rotation, a glide surface 29, the cutting edge 12 embedded in or near the glide surface 29, the nib 8 set to operate near the cutting edge 12, and nothing on the leading section 88 of the axis of rotation. By removing elements from the leading section 88 of the longitudinal axis of rotation, friction may be reduced and obstructions may be removed, thus enabling the cutting edge 12, nib 8, and glide surface 29 to easily traverse the target material 86 and rotate, with minimal friction, to orient the cutting edge and nib correctly for operation, thus making the device 1 easier to operate, particularly when a device is used in conjunction with an alignment apparatus 44 (in FIG. 3) or 48 (FIGS. 4*a* and 4*b*).

The tip may include a depth-stop wear indicator 34 (FIG. 2*b*) that notifies or indicates to the user of depth-stop wear to the tip 6, the nib 8, and the blade 10, or combinations thereof. The depth stop sets how much of the cutting edge 12 is presented to the target material 86. If the depth stop wears down, it may expose more of the cutting edge. A depth stop wear indicator 34 will notify the user of this change, so the user can take appropriate caution or action. Because the depth that the cutting edge 12 protrudes (typically less than the protrusion of the nib 8) is useful for safety, a wear indication will further improve safety while cutting target material 86.

One such embodiment of a depth-stop wear indicator 34 is an indicator that changes color as the glide surface 29 or cutting edge support 36 (FIGS. 2*a* and 2*b*) or any other part of the tip 6 wears down, thus showing the user that the cutting edge 12 is more exposed than necessary. This is done by providing a surface that wears as it touches the target material 86 having multiple layers of different colors. Thus when one layer is worn away, the user sees a different color and knows that the depth of the cutting edge 12 is more because the thickness of the surface of the target area is less. As the surface wears down, the feel and sounds created during cutting may change as well such as an increase in friction about the surface and hearing the target material rip, stretch, crumple, scrape, scratch, or resist.

Another depth-stop wear indicator 34 embodiment comprises a pin that becomes exposed as the glide surface 29 wears down. The pin's point, once exposed, would stop the device 1 from performing properly because it would tear the target material 86 or not let the device 1 rotate in an alignment apparatus or move smoothly. The pin, in the previous example, would also change the noise made as the device is used. A combination of depth-stop wear indicator types would notify the user via visual means, auditory means, and kinesthetic means.

The tip 6 may also have edges or cutting edge supports 36 that can be used to interface with a template, guiding the user to follow a template to create specific shapes and edges, with precision and ease. The tip may also be shaped so it may automatically move to a non-functional position, in a visible, auditory and kinesthetic way, when held in a less than ideal orientation. The tip 6 may have a chamber, angled surface, or guide next to the nib 8, cutting edge 12, and glide surface 29 so that if the user moves the device 1 off axis, the tip 6 will rotate to a stop and then only glide along the target material 86 without rotating, cutting, or decorating.

Referring now to an alignment apparatus. An alignment apparatus 44 or 48 holds a device 1 in place to allow for easy and comfortable use of a device 1 when cutting or decorating and may be in the form of a holder 44 or a barrel 48. In preferred embodiments, the device 1 is secured to the alignment apparatus by friction whereas in other embodiments, the device 1 is permanently secured to the alignment apparatus 44 or 48. In an alternative embodiment, the tip 6 may make contact with the target material 86 at a desired angle other than 90 degrees with an offset to compensate for a user's tendency to exert different pressure when the user pulls, pushes, or slides the device 1.

Figure 3:
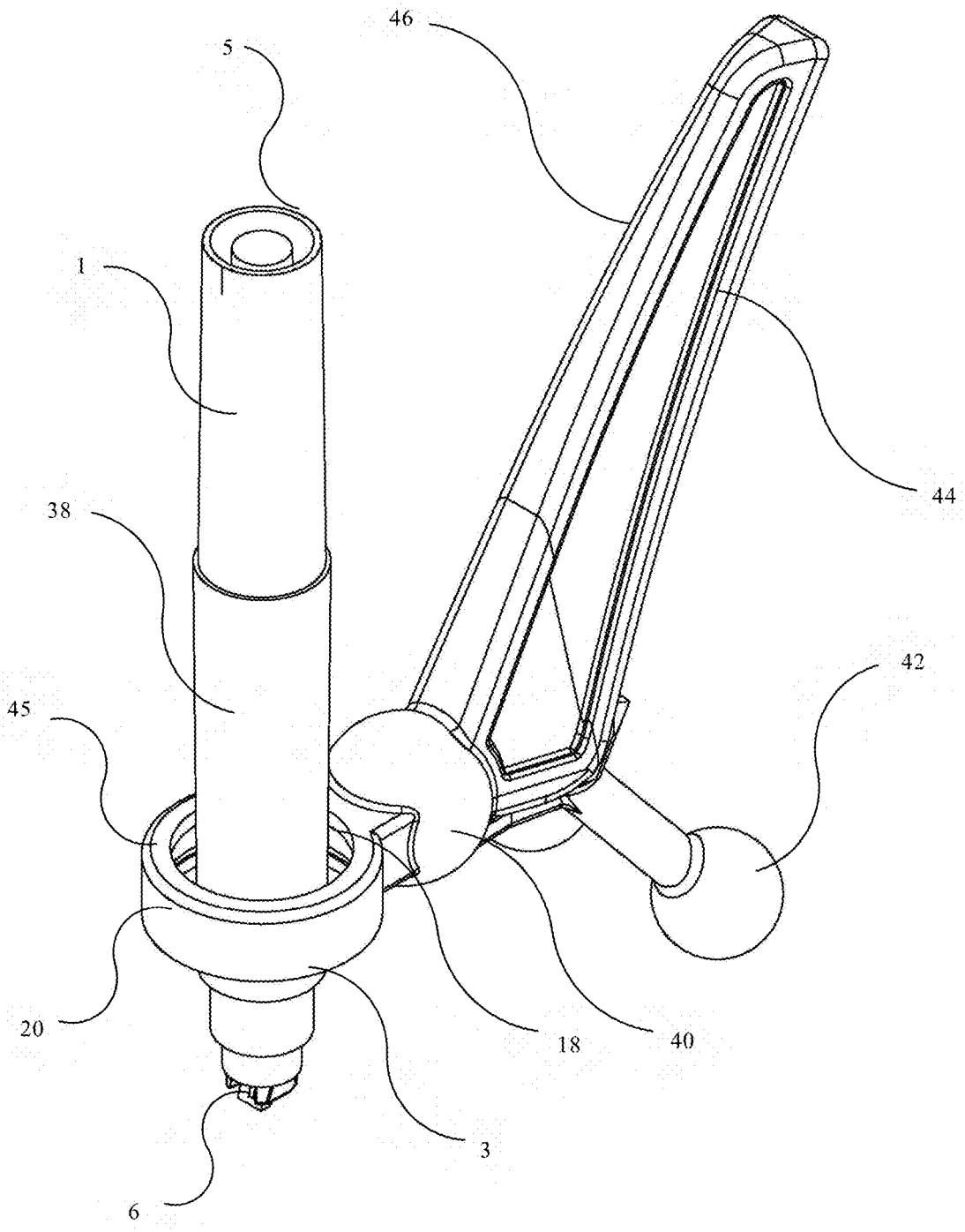
FIG. 3 illustrates a perspective view of a device placed in a handle holder alignment apparatus.
Figure 4A:
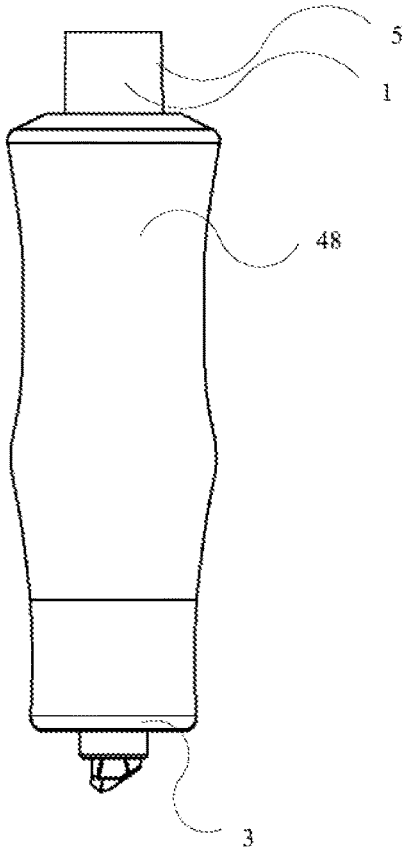
FIG. 4*a* illustrates a front view of a device placed inside a barrel alignment apparatus.
Figure 4B:
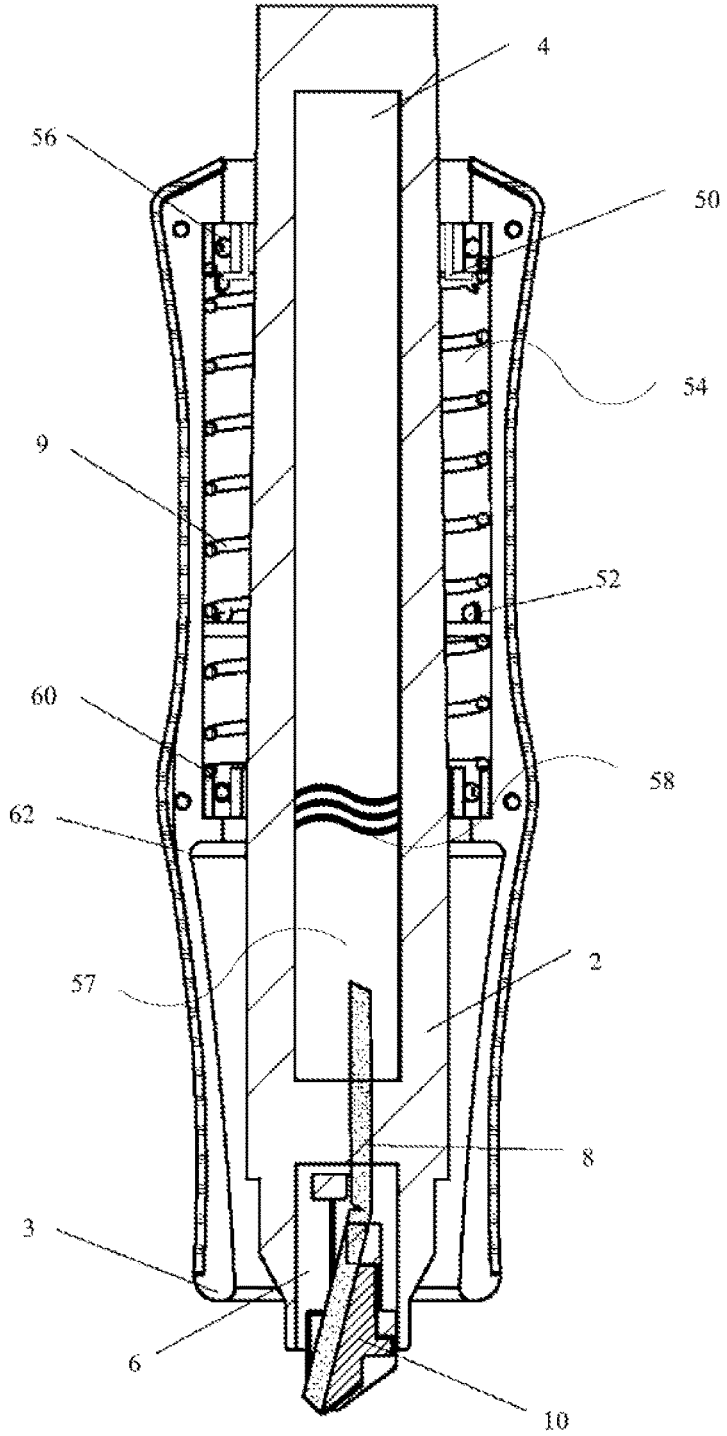
FIG. 4*b* illustrates a vertical cross-section view of the interior contents of a device placed inside a barrel alignment apparatus.

In an exemplary embodiment as shown in FIG. 3, a holder 44 may facilitate preferred 90-degree placement of a tip 6 to a target material 86. An alignment apparatus may comprise of a device holder 44 that may contain a rotatable cuff 38 to hold the device, at least one stand or leg 42 to orient the device 1 and rotatable cuff 38 and at least one handle 46 to hold the device holder 44 during operation. The holder alignment apparatus may comprise a joint 40 that may be a spherical shape or other shape and may connect to a rotatable cuff ring 45. The joint, which may be movable or fixed, can be rotated to change the orientation of the handle 46 to enable it to be gripped at different angles. A device holder 44 may comprise a single part, multiple parts, interchangeable parts, removable parts, or fixed parts. The distal end 5 of the alignment apparatus may be open ended to allow the distal end of the device 1 to show and to move freely about a longitudinal axis of rotation. The cuff ring 45 may contain within its circumference a bearing 16 that may have an inner ring 18 inside an outer ring 20 with ball bearings 22 in between the rings 18 and 20 (Shown in FIG. 1). Inside the circumference of the inner ring 18 is the rotatable cuff 38 fixedly attached to the inner ring 18. A bearing 16 may have a single component or may be comprised of multiple components. Examples of a bearing 16 are a bushing, a rotator cuff, a roller bearing that may be tapered or cylindrical, or concentric annular rings. The inner ring 18, with bearings 16 between the inner ring 18 and outer ring 20, rotates, so the pressure and direction the user is applying will facilitate improved perpendicular contact to a target material 86 while friction at the distal end 5 may be reduced while the device 1 is placed inside the alignment apparatus 44 or 48.

When the device 1 is inserted, the end of the nib 8 should be able to touch the target material 86 in cooperation with at least one leg 42. In other embodiments the leg 42 will bias the orientation of the device 1 to a functional orientation to the target material 86 whereby the orientation is angled to allow for continuous gliding about the surface of the target material 86 and to allow for continuous cutting. In preferred embodiments, the preferred smooth surface of the leg 42 will glide along target material with the same or less friction as the tip 6 glides along the target material surface. In preferred embodiments, the leg 42 will also provide for a means to prevent buildup of decorating material. In alternative embodiments, two legs 42 may be attached to the bottom of the handle 46 and angled away from the handle 46 so as to form a tripod when the device 1 is inserted into the rotatable cuff 38.

In an exemplary embodiment, a barrel alignment apparatus may contain at least one elongated shaped barrel body 48 with proximal 3 and distal 5 ends, at least one rotational bearing 16, at least one compression resistance device such as a spring 9 in a spring chamber 54 and at least one orientation element such as a glide support or a glide surface 29 at the proximal end 3 of the device 1 that contacts the target material 86. In some embodiments, a barrel may be another shape such as a triangular shape, square or rectangular shape, or a spherical shape.

At the distal end, a device stabilizer 24 may have an annular shape to match the circumference of a spring 9 and be present at the distal end of the spring and latch into the inner circumference of a distal bearing 16. The device stabilizer 24 may latch into the bearing with a series of protrusions, legs, clasps, or by any other fastener means. The alignment apparatus may accommodate multiple devices, enabling performance of many different tasks, or may be permanently attached to a single device to perform a specific set of tasks.

In some embodiments, an alignment apparatus may be made out of natural and synthetic materials. The alignment apparatus body 48 may have a fixed shape, may have a bendable shape, or may be adjustable to fit a user's needs and to fit various lengths and widths of device and may be either shorter or longer than but must be sufficiently wide enough to contain the interior components yet allow movement of the spring 9 and the device 1 during use. Other variant embodiments of the device include features of a contoured grip 62 such as finger and hand placement guides such as molding or tapering for improving grip. The alignment apparatus barrel body 48 may be a single piece or may be formed by two interlocking longitudinal halves 26 that may be secured together by frictional fitting or with a fastener such as a screw, snap, glue, rivet or other means to join. In some embodiments, a device and an alignment apparatus may be one in the same and comprise at least one bearing, at least one spring, at least one reservoir, and at least one tip. A proximal device cap 73, with a tip 6 either fixably or removably attached or inserted into an aperture of the proximal device cap 73, may be inserted into a proximal aperture 14 of a device 1 or of a singular barrel body 48 to provide for a more closed and solitary system.

The alignment apparatus may contain at least one bearing 16 to allow for frictional securing of a device 1 but also free rotation of a device 1 about a longitudinal axis. The alignment apparatus barrel body 48 may be contoured so that the proximal end 3 is tapered with a wider circumference in the same position as a proximal bearing 60 and a proximal aperture 14 with the lesser circumference. In some embodiments, a distal bearing 56 may fixedly or loosely lay on a bearing stop 52 in the form of an interior ledge 66 that may be present completely or discontinuously around the inner circumference of an internal chamber 68 as shown in FIG. 4*b*.

The internal chamber 68 of the alignment apparatus may contain at least one spring 9. The spring 9 may be a rotating compressible spring with a rotating interface to the spring as shown in FIG. 5*b*. In this example, the distal end of the spring 9 may be fixedly connected to a distal bearing 56. The proximal end of the spring 9 may or may not be open ended 70 and not connected to any bearing 16. A rotatable and compression spring bearing assembly may have a spring 9 that rests loosely on a ledge 66 between a proximal 60 and a distal 56 bearing through which a device 1 is threaded through the inner circumference. However, there may be a device barrel holder 50 formed with at least two angled protrusions or ledges to help secure the device 1 in the alignment apparatus barrel body 48, while still allowing rotation about a longitudinal axis.

Figure 5A:
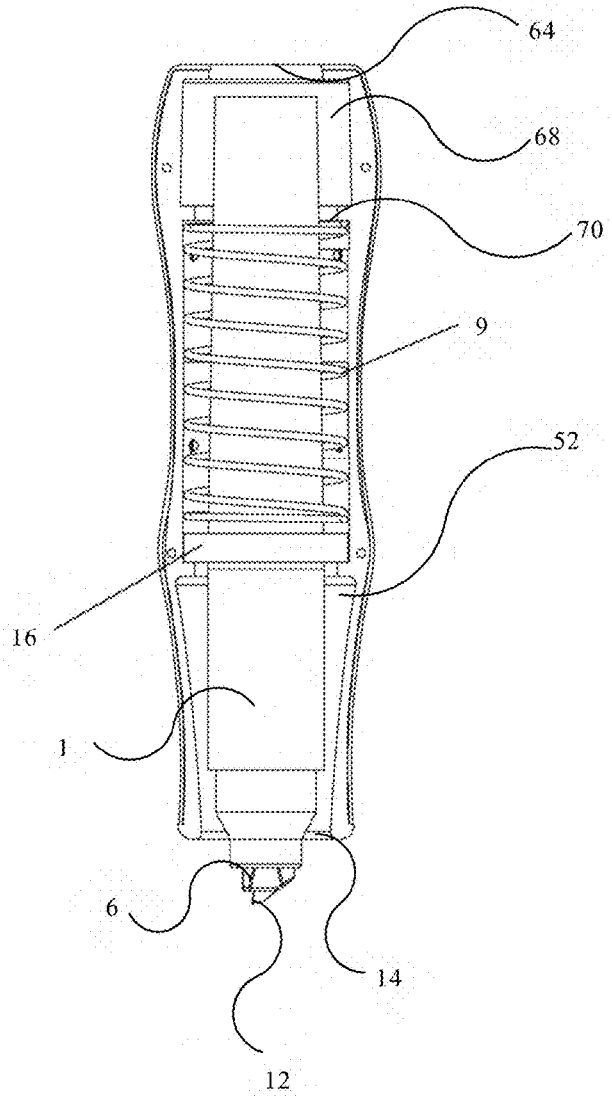
FIG. 5*a* illustrates a vertical cross-section view of a device in a barrel alignment apparatus with a non-rotating compressible spring.
Figure 5B:
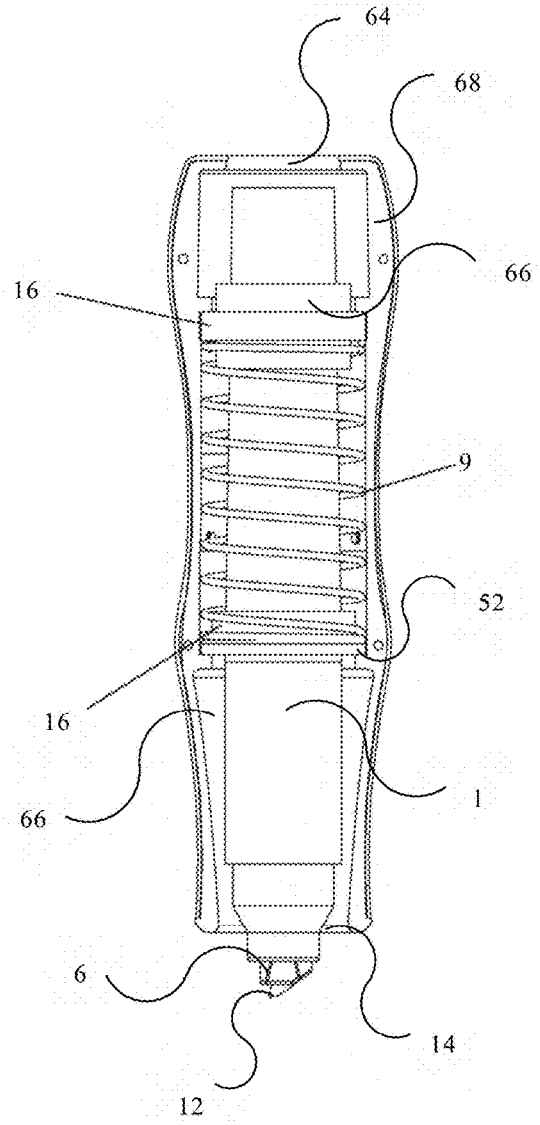
FIG. 5*b* illustrates a vertical cross-section view of a device in a barrel alignment apparatus with a rotatable compressible spring.

In the alternative, some embodiments may contain a non-rotating compression spring as shown in FIG. 5*a*. This spring type has a bearing at the proximal end 60 but is open ended at the distal end 70. The proximal bearing 60 secures the device 1 with friction, and the open distal end 70 allows for free rotation of the device 1.

The distal end 5 or inner circumference of the distal aperture 7 of the device may not be in contact with the distal bearing 56 or secured to the distal bearing 56 with friction. The distal end 5 of the alignment device may be flared and have a greater circumference about the position of the distal bearing 56. In some embodiments, the distal end 5 may curve over the top of the aperture 7. In some embodiments, the distal end 5 may contain additional fasteners such as clips or magnets to where a user may attach a covering or accessory. The accessory may be decorative such as a character or a shape or may be a device that is functional such as an eraser.

In some embodiments, the alignment apparatus body 48 may comprise a material coating with a low coefficient of friction to allow for efficient movement of the alignment apparatus along the surface of target material. The material coating may comprise polytetrafluoroethylene, ceramic and ceramic alloys, steel, brass, polished wood, smooth plastics, or any other material with a low coefficient of friction to provide for efficient gliding along a target material 86. Furthermore, the surface may be easy for a user to wipe clean with a simple damp towel or tissue or textured material.

The alignment apparatus body, or a portion thereof, may be clear such as being made out of acrylic, so the user may have an unobstructed view of the device tip 6 applying decorating material 58 to the target material 86 while the system of the device 1 along with the alignment apparatus 48. The alignment apparatus barrel body 48 may also contain various decorations, sheaths, or any other type of covering to decorate or add comfort to the alignment apparatus. In some embodiments, the alignment apparatus barrel body 48 may contain lenticular lenses with interlaced images or lenses which cooperate with images on the device 1. As the user glides the alignment apparatus along a target material 86, the user may witness different images appearing based on the angle of view or how the alignment apparatus is being rotated. In addition, the device housed inside the alignment apparatus may be decorated to correspond to the decoration or lenticular lens to further allow customization of the image displayed. In some embodiments, the alignment apparatus may contain a slit where a user may insert a sheet containing a drawing, photograph, or other craft, thus allowing the user more customization options.

Figure 6:
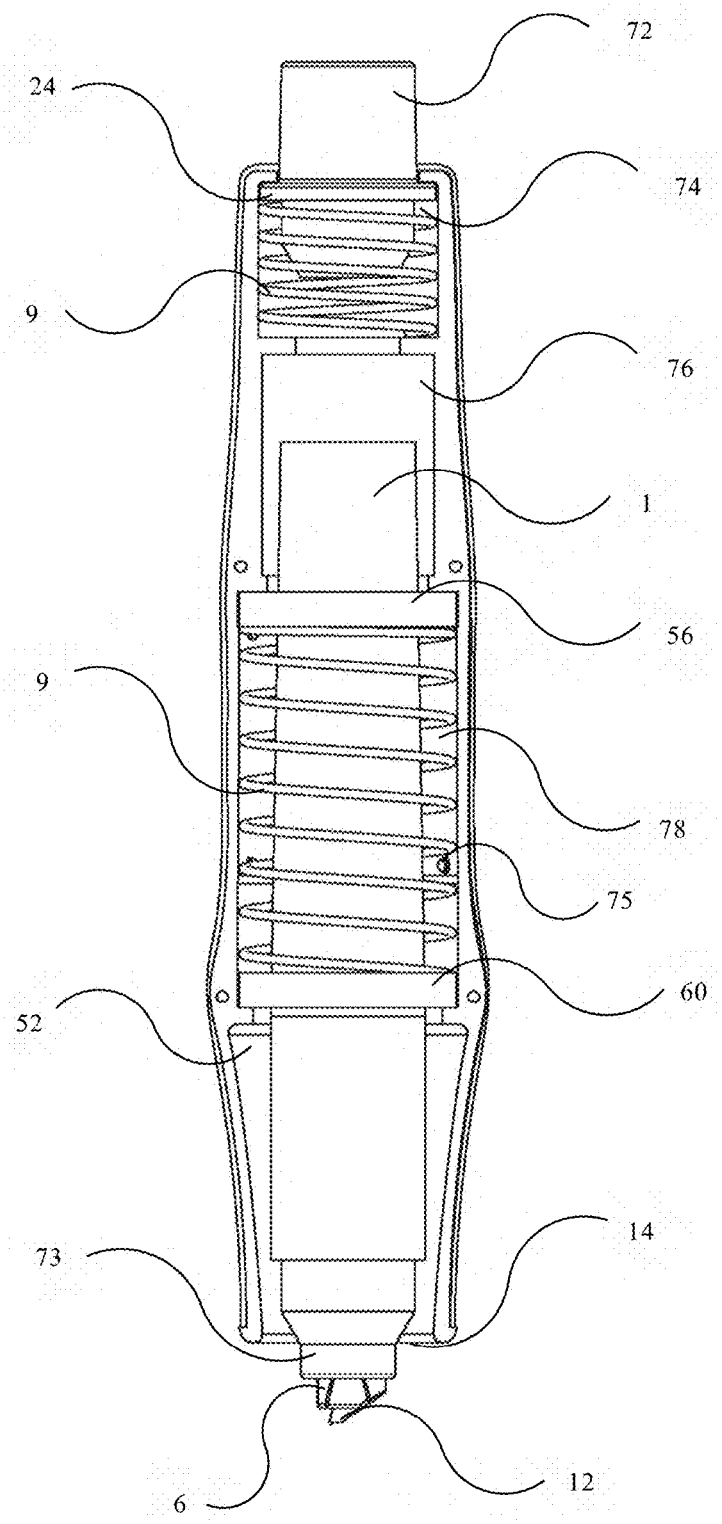
FIG. 6 illustrates a vertical cross-section view of a retractable and ejectable device inside a barrel alignment apparatus having two spring chambers.

An alignment apparatus with a retractable device may be provided as a single fixed system or an interchangeable system where a user can insert different devices 1 into a separate alignment apparatus barrel body 48. The alignment apparatus providing a retractable function may have two spring chambers, a proximal spring and chamber 78 and a distal spring and chamber 74 as shown in FIG. 6. The alignment apparatus may contain at least one bearing 16 to allow for frictional securing of a device 1 but also free rotation of a device 1 about a longitudinal axis while limiting the pressure a user can apply.

The distal bearing 56 may fixedly or loosely lay on a bearing stop 52 in the form of an interior ledge 66 that may be present completely around the inner circumference of the chamber or may be present as a discontinuous ledge 66 about the inner circumference of the spring chamber 54.

A distal chamber 74 may contain a spring, a depressor or distal end cap 72, and a device 1. The distal end 5 of the device 1 may fit into the barrel body 48 and may be secured by friction or another means. The depressor or distal end cap 72 may be fixedly or loosely attached to the distal spring 9. When a user pushes the depressor or distal end cap 72 to compress the distal spring 9 and in turn the proximal spring 9, the springs may regress until interior chamber nodules 75 prevent the spring from recoiling. Pressing the depressor or distal end cap 72 can eject the device 1 from the alignment apparatus barrel body internal chamber 68.

Inside the bearing 16, there may be an inner ring 18 that allows partial or full 360-degree rotation within a stationary outer ring 20. In between the inner ring 18 and outer ring 20, there may be a receptacle 11 to accommodate ball bearings 22 to allow rotation of the inner ring 18. The bearing 16 may be set at an angle to compensate for the forces exerted during hand use. For example, if a person has the tendency to push down when pushing away and to pull up when pulling toward him/her, then a design with an angled inner ring 18 and outer ring 20 may aid to equalize those forces. There may be two or more nodules 75 about the internal chamber 68 of the barrel body 48 that prevent the spring 9 from recoiling and helps to minimize the possibility of injury from "launching" a projectile from the alignment apparatus internal chamber 68 and device retraction chamber 76.

Referring now to a planned-thickness target material project pad. A planned-thickness or predetermined thickness target-material project pad 84 (Shown in FIGS. 7*a*, 7*b*, and 7*c*) may contain multiple layers of target material 86. A single pad 84 may contain target material 86 of different shapes, colors, composition, materials and textures, or the pad 84 may comprise a single type of target material 86. The pad 84 may contain target material 86 of varying thickness. The pad 84 may be in the form of a book, journal, scrapbook, portfolio, roll, scroll, notepad, or stacked columnar pad with or without a spine binding, or with or without any binding.

The pad 84 may eliminate the need for a user 82 to utilize a cutting mat or other protective surface for effective and precise cutting. In some embodiments, a selected device 1 with a blade 10 with a cutting edge 12 of a given length and thickness will only cut through the pad layer with a thickness corresponding to the depth the cutting edge will cut. In some embodiments, a layered pad 84 may be organized by thinnest target material 86 on top to thickest target material on bottom or in no particular order, or in staggered or alternating patterns or arranged by material type, style or color or arranged in the sequence of project steps.

In some embodiments, the pad 84 may be pre-designed or pre-determined to conform to a particular theme or art project. In such embodiments, a pad 84 may come with tracing outlines and directions for how to use and create a certain project and the materials needed to complete all or parts of the project.

For example, a pad 84 may be part of a kit for paper dolls. Different layers of target material 86 in the pad 84 may correspond to particular doll clothes that a user may simultaneously outline and precisely cut. A user may also outline and cut pre-marked shapes or patterns on the target material 86. Because the thickness of the target material is coordinated with the thickness of the cutting edge 12, a user can cut without the need for a cutting mat simply by using the pad 84 with the pages of the target material 86 in the order it was designed to be used. Sticker sheet stock, and other such multi-layer target material 86, will be designed so that the thickness of the functional or surface layer is thinner than the cutting edge 12, but a backing or lower layer protects the layers behind it. This will enable a user to cut out the top layer and leave the remaining layers unchanged.

Referring now to a material application and cutting system and kit. A material application and cutting system may comprise all of the above disclosed apparatuses and alternatives of those apparatuses or less than all of the above disclosed components. In some embodiments, a variety of devices 1 may be grouped together. Each device 1 may contain a different decorative material 58. In some embodiments, the devices 1 and alignment apparatuses 44 and 48 may be housed and presented in a storage case or bag. The storage case or bag may make it more convenient for the user to carry or tote the materials to different locations and help keep material application and cutting projects organized. The storage case may have several compartments or designated compartments specifically to fit the alignment apparatus 44 or 48, device 1, planned-thickness target material project pad 84, and other miscellaneous material application and cutting supplies. The combination of the cutting edge depth, planned-thickness target material project pad, device and decorating material, tip shape, and alignment apparatus assist the user in completing a task with creativity, fun, and safety.

Referring now to methods of using a device with an alignment apparatus and a planned-thickness target material project pad. When the device 1 is inserted into an alignment device 44 or 48, the device 1 should be oriented such that the tip 6, nib 8, cutting edge 12, and cutting edge support 36 are all oriented such that the device can easily rotate about the longitudinal axis of rotation in the rotatable cuff comprising at least one bearing 16. The tip 6 may make contact with the target material at an angle that may be from 10 degrees to 170 degrees. For reference, when the device 1 is perpendicular to the target material surface 86 where the proximal end 3 is closest to the target material, the device is positioned at 90 degrees. When the distal end 5 of the device 1 is tilted toward the trailing section 90, the angle decreases. When the distal end 5 of the device 1 is tilted toward the leading section 88, the angle increases.

A user selects a device 1 and inserts the device 1 into the alignment apparatus 44 or 48 with the distal end 13 of the device preferably inserted through the proximal aperture 14 of the alignment apparatus 44 or 48. The proximal end 3 of the alignment apparatus 44 or 48 may face upward or downward for device 1 insertion. The user may retract the distal end 13 of the device to compress the alignment apparatus 48 spring 9 up to the nodule 75 by pulling the distal end 5 of the device downward. The nodule 75 may be an internal flare, raised dot, ledge, or protrusion that grasps onto or presses against a device 1. The device 1 prevents a user from pressing too hard and from tilting the position of the blade as a result of the spring compression which may vary depending on the length, thickness, and material of the spring 9. While the user applies pressure to the alignment apparatus 44 or 48, the compressibility of the spring 9 either evens out the pressure or reduces excessive pressure to the device 1 to prevent bending or damage to the nib 8 or the blade 10. No matter how much pressure a user applies, since the pressure is applied to the alignment apparatus 44 or 48 and not directly to the device 1, the pressure is limited to the maximum pressure and compressibility the spring can exert once the alignment apparatus 44 or 48 engages the target material 86. The spring 9 can be any type and with any spring force or compressibility suitable for use in cutting and decorating devices; the precise force and compressibility are not essential. The spring 9 may be interchangeable to suit a user's preference.

The structure of the alignment apparatus 44 or 48 may allow the user to simultaneously cut and decorate in shapes having very small angles without needing to lift up the device and alignment apparatus from the target material (see FIGS. 7*a*, 7*b*, 7*c*). Instead of a user needing to rotate the wrist to change direction of the device 1 along the target material 86, the alignment apparatus 44 or 48 will allow for the device 1 to rotate while inside the alignment apparatus 44 or 48. The user may glide the device 1, by way of the alignment apparatus 44 or 48 and with the assistance of the orientation element which may be a cutting edge support 36, glide surface 29, or a placement guide or template may be used in conjunction with a device (with or without an alignment apparatus) 1 and target material 86, or any combination, along the surface of the target material 86. As the user glides the device 1 by way of the alignment apparatus 44 or 48 along the surface of the target material 86, the alignment apparatus 44 or 48 may orient the device 1 into the optimal position for use.

For an example of using a retractable device and alignment apparatus as illustrated in FIG. 6, the alignment apparatus 48 and the device 1 may be combined into a single fixed device where a user only needs to press the distal end 5 of the alignment apparatus to compress the distal end spring 9 which compresses the proximal end spring 9 to push the device tip 6, so the device tip 6 protrudes out of the proximal end 3 of the alignment apparatus 48. A user 82 may press the device tip 6 straight down onto the target material 86 to compress the proximal spring 9 as shown in FIG. 7*a*. The orientation element such as a glide surface 29 or cutting edge support 36 is then flush with and in contact with the surface of the target material 86. The user 82 may then glide the alignment apparatus 48 along the target material 86. To eject the device 1 from the alignment apparatus 48, a user may press the distal end cup 72 into the device retraction chamber 76 with his/her thumb to release the device 1 from being secured with friction to the proximal end bearing 60 in the proximal spring chamber 78 as shown in FIG. 6.

CONCLUSION

The foregoing is a description of decorating and cutting device, alignment apparatus, planned-thickness target material project pad that form a material application and an alignment apparatus system and kit and methods of use thereof. However, it is to be understood the present invention is not limited to the particular descriptions disclosed and shown in the drawings. The present invention also comprises any modifications or equivalents within the scope of the claims.

What is claimed is:

1. A material application and cutting system comprising at least one device and at least one alignment apparatus, wherein the device comprises a device housing, a proximal aperture, a distal end, at least one reservoir, a tip, a nib, and a blade, and wherein the blade comprises a cutting edge, a blunt end, an angled side, a protruding side, and a cutting edge support, and wherein the tip comprises a glide surface outward from the proximal aperture and from which the blade cutting edge protrudes, and wherein the alignment apparatus is a handle holder comprising at least one bearing, a proximal end, a distal end, a rotatable cuff, at least one joint, a cuff ring, two legs connected to a handle to form a tripod, and a holder.

2. The system of claim 1 wherein the the bearing is a bushing, a roller bearing, or concentric annular rings.

3. The system of claim 1 wherein the bearing comprises an inner ring, an outer ring, a receptacle, and ball bearings to facilitate rotation of a device or of a reservoir.

4. The system of claim 1 wherein the device and the alignment apparatus are separate and interchangeable.

5. The system of claim 1 wherein the device and the alignment apparatus are fixed together so as to be a single apparatus.

6. The system of claim 1 further comprising a target material project pad.

7. The system of claim 1 wherein the at least one device and the at least one alignment apparatus are provided in a kit.

8. The system of claim 7 further comprising in the kit a target material project pad.

9. The system of claim 1 further comprising decorating material inside the reservoir.

10. The system of claim 9 wherein the decorating material is selected from a group consisting of inks, dyes, glues, colored glues, pigments, clear coats, gels, lacquers, polishes, paints, etching solutions, graphite, oil pastels, oils, stains, waxes, glitter, emulsions, glow-in-the dark substances, fluorescent substances, crayons, black-light sensitive substances, three-dimensional paints, water, foams, fragranced substances, and combinations thereof.

11. The system of claim 1 herein the tip comprises an interior portion and an exterior portion.

12. The system of claim 1 wherein the blade comprises a cutting edge, a blunt end, an angled side, a protruding side, and a cutting edge support.

13. The device of claim 1 further comprising a depth-stop wear indicator.

14. The system of claim 13 wherein the depth-stop wear indicator is a color change indicator.

15. The system of claim 13 wherein the depth-stop wear indicator is a pin.

16. The system of claim 1 wherein the joint is movable.

17. The system of claim 1 wherein the joint is fixed.

18. A material application and cutting system comprising at least one device and at least one alignment apparatus, wherein the device comprises a device housing, a proximal aperture, a distal end, at least one reservoir, a tip, a nib, and a blade, wherein the blade comprises a cutting edge, a blunt end, an angled side, a protruding side and a cutting edge support, and wherein the tip comprises a glide surface outward from the proximal aperture and from which the blade cutting edge protrudes, and wherein the alignment apparatus comprises as least one bearing, and a holder, and Wherein the alignment apparatus is a barrel holder with an internal chamber comprising at least one spring, at least one glide surface, at least one bearing stop, at least one spring chamber, a proximal aperture, at least one nodule, and a barrel body.

19. The system of claim 18 wherein the barrel body is comprised of two longitudinal barrels.

20. The system of claim 18 wherein the barrel body is a single barrel piece.

21. The system of claim 19 wherein the barrel body is contoured.

22. The system of claim 20 wherein the barrel body is contoured.

23. The system of claim 18 further comprising a device stabilizer.

24. The system of claim 18 further comprising a distal end cap, a distal spring chamber, a device retraction chamber, and a proximal spring chamber.

25. The system of claim 23 further comprising a distal end cap, a distal spring chamber, a device retraction chamber, and a proximal spring chamber.

26. The system of claim 25 comprising one proximal spring housed in the proximal spring chamber and one distal spring housed in the distal spring chamber.

27. The system of claim 26 wherein the device of claim 10 is threaded through the at least one bearing and the proximal spring and the distal spring.

28. The system of claim 27 wherein the device is retractable.

29. The system of claim 27 wherein the device is ejectable.

30. The system of claim 18 wherein the spring is a non-rotating compressible spring.

31. The barrel holder of claim 18 wherein the spring is a rotatable compressible spring.

32. A method of simultaneously decorating and cutting with a material application and cutting system comprising at least one device and at least one alignment apparatus, wherein the device comprises a device housing, a proximal aperture, a distal end, at least one reservoir, a tip, a nib, and a blade, wherein the blade comprises a cutting edge, a blunt end, an angled side, a protruding side, and a cutting edge support, and wherein the tip comprises a glide surface outward from the proximal aperture and from which the blade cutting edge protrudes, and wherein the alignment apparatus comprises as least one bearing, and a holder, and Wherein the alignment apparatus is a barrel holder with an internal chamber comprising at least one spring, at least one glide surface, at least one bearing stop, at least one spring chamber, a proximal aperture, at least one nodule, and a barrel body, the method steps comprising:

selecting at least one device, inserting the device into the alignment apparatus, and applying the proximal end of the device to target material while gripping the alignment apparatus, and applying pressure to the target material.

33. The method steps of claim 32 whereby applying pressure to the target material facilitates the deposition of decorating material from the nib onto the target material.

34. The method steps of claim 32 whereby applying pressure to the target material facilitates the puncture of the target material by the blade cutting edge.

35. The method steps of claim 32 whereby applying pressure to the target material causes the spring to compress.

36. The method steps of claim 32 wherein the target material is a target material project pad with multiple layers of material with varying thicknesses.

37. The method steps of claim 32 further comprising the step of pushing or pulling the alignment apparatus toward a leading section and leaving a trailing section.

38. The method steps of claim 37 whereby a user creates a shape that is cut out from the target material and outlined with decorating material.

39. The system of claim 18 wherein the bearing is a bushing, a roller bearing, or concentric annular rings.

40. The system of claim 18 wherein the bearing comprises an inner ring, an outer ring, a receptacle, and ball bearings to facilitate rotation of a device or of a reservoir.

41. The system of claim 18 wherein the device and the alignment apparatus are separate and interchangeable.

42. The system of claim 18 wherein the device and the alignment apparatus are fixed together so as to be a single apparatus.

43. The system of claim 18 further comprising a target material project pad.

44. The system of claim 18 wherein the at least one device and the at least one alignment apparatus are provided in a kit.

45. The system of claim 44 further comprising in the kit a target material project pad.

46. The system of claim 18 further comprising decorating material inside the reservoir.

47. The system of claim 18 wherein the decorating material is selected from a group consisting of inks, dyes, glues, colored glues, pigments, clear coats, gels, lacquers, polishes, paints, etching solutions, graphite, oil pastels, oils, stains, waxes, glitter, emulsions, glow-in-the dark substances, fluorescent substances, crayons, black-light sensitive substances, three-dimensional paints, water, foams, fragranced substances, and combinations thereof.

48. The system of claim 18 wherein the tip comprises an interior portion and an exterior portion.

49. The system of claim 18 further comprising a depth-stop wear indicator.

* * * * *